US008172432B2

(12) United States Patent
Liu

(10) Patent No.: US 8,172,432 B2
(45) Date of Patent: May 8, 2012

(54) CONDENSING DEVICE FOR LED

(76) Inventor: Pao-Hsiu Liu, Taipei (TW)

( * ) Notice: Subject to any disclaimer, the term of this patent is extended or adjusted under 35 U.S.C. 154(b) by 254 days.

(21) Appl. No.: 12/616,116

(22) Filed: Nov. 10, 2009

(65) Prior Publication Data

US 2010/0135010 A1 Jun. 3, 2010

(30) Foreign Application Priority Data

Nov. 28, 2008 (TW) ..... 97146379 A

(51) Int. Cl.
*F21V 7/04* (2006.01)

(52) U.S. Cl. ..... 362/308; 362/235; 362/328; 362/329; 362/249.06

(58) Field of Classification Search ..... 362/235, 362/247, 249.02, 249.06, 545, 308, 328, 362/329
See application file for complete search history.

(56) References Cited

U.S. PATENT DOCUMENTS 4,563,668 A * 1/1986 Martino ..... 340/908.1
6,364,506 B1 * 4/2002 Gallo ..... 362/245
6,366,214 B1 * 4/2002 Mitchell et al. ..... 340/815.45
7,461,951 B2 * 12/2008 Chou et al. ..... 362/294
7,506,985 B2 * 3/2009 Radominski et al. ..... 353/94

* cited by examiner

*Primary Examiner* — Thomas Sember

(57) ABSTRACT

A condensing device for LED includes a base arranged with LED on a surface thereof and a projecting lens aligned to a center of the base. Lights from the LED will be concentrated by the projecting lens without scattering.

7 Claims, 7 Drawing Sheets

CONDENSING DEVICE FOR LED

FIELD OF THE PRESENT INVENTION

The present invention relates to condensers, and particular to a condensing device for LED capable of projecting concentrated lights for LED.

DESCRIPTION OF THE PRIOR ART

Prior spot lights use lamp as a light source, while LED is now taking place of the lamp for it's power saving, environment-friendly, and multiple choices of color.

However, while projecting lights from multiple LEDs to an object, multiple shadows will appear because of the straight projection of the LEDs so that it is not good for light control such as a stage illumination.

Therefore, to provide a condensing device to solve above disadvantage and to further concentrate lights of LEDs for a better illumination purpose is a primary object for the inventor of the present invention.

SUMMARY OF THE PRESENT INVENTION

Accordingly, the primary object of the present invention is to provide a condensing device for LED.

To achieve the above object, the present invention includes a ring base having a cone shaped opening with a wider opening on a top and a narrow opening on a bottom thereof. LED is arranged to a surface of the base, and a frame is fixed to the top of the base.

The condensing device for LED further includes a projecting lens fitted in a gasket. The gasket can be fixed to an inner flange of the frame so that the projecting lens is aligned to a center of the opening of the base.

Through above components, the condensing device for LED is capable of projecting concentrated beam from LED so that the present invention will have a better light effect while applied to a stage.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
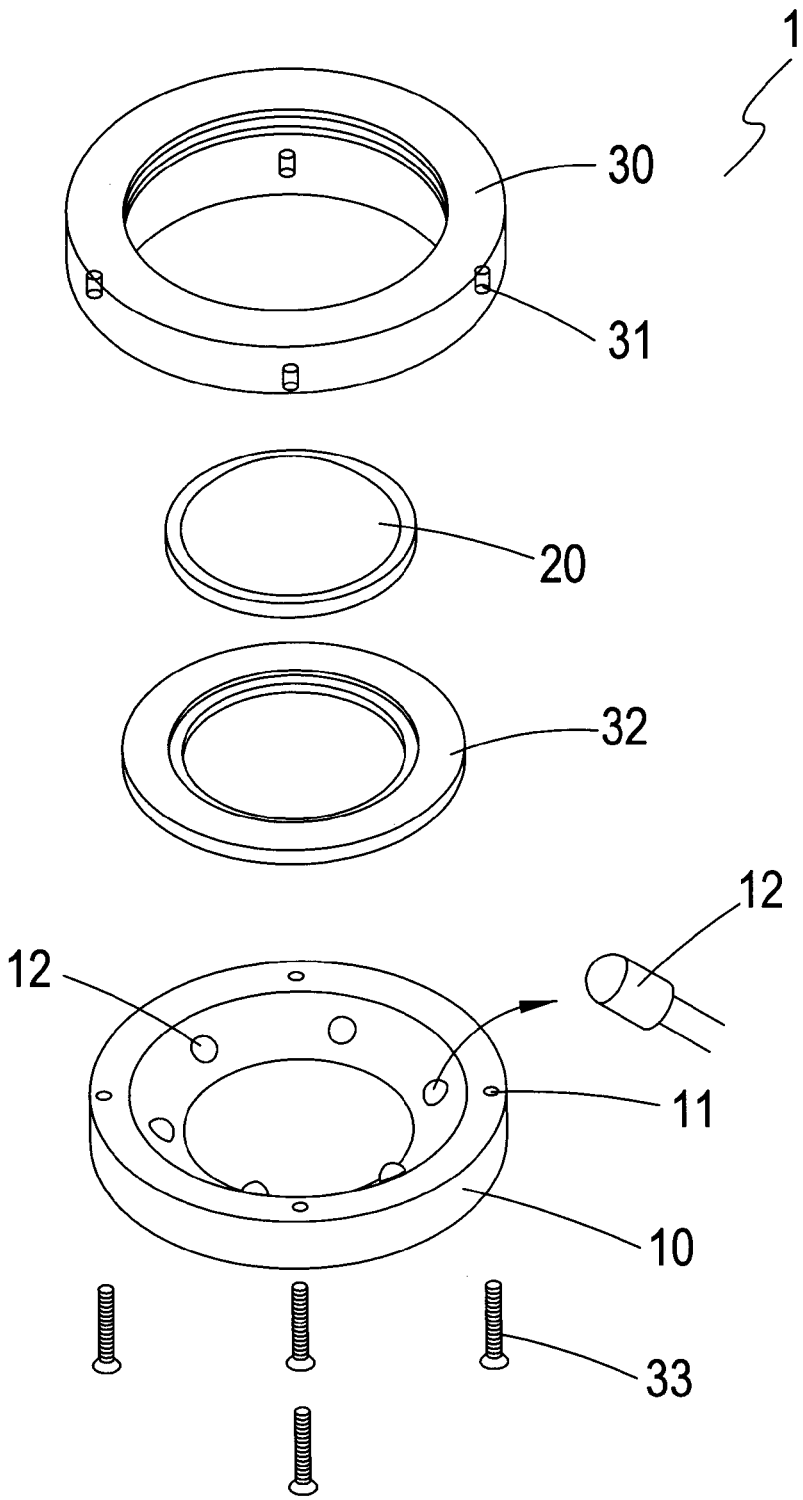
FIG. 1 is an exploded view of the present invention.
Figure 2:
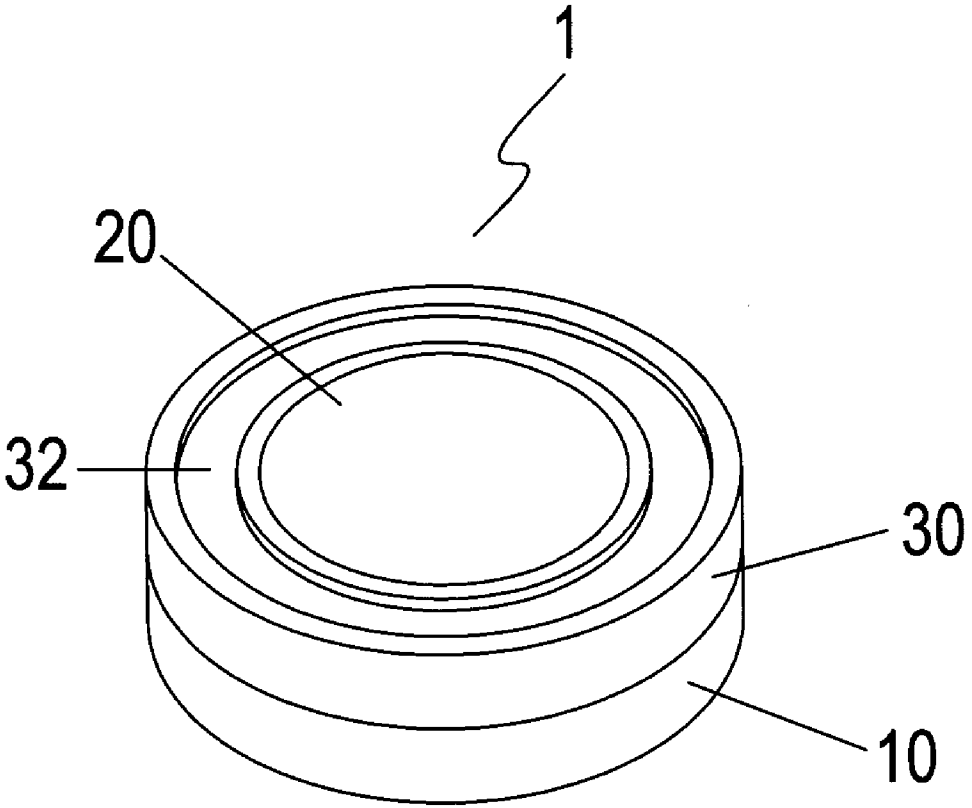
FIG. 2 is a schematic view of the present invention.

Referring to FIGS. 1 and 2, an exploded view and an schematic view of a preferable embodiment of a condensing device 1 for LED (Light Emitting Diode) according to the present invention are illustrated. The condensing device 1 includes a ring base 10. A cone shaped opening in a center of the ring base 10 is like a funnel with a wider opening on a top and a narrow opening on a bottom thereof. A plurality of LEDs 12 is arranged to an inclined surface of the opening of the ring base 10. The base 10 has a plurality of through holes 11 for screws on an edge thereof. A frame 30 has a plurality of threaded holes 31 on a bottom side thereof. The plurality of through holes 11 is opposite to the plurality of threaded holes 31. The frame 30 is fixed to the base 10 from the top by bolts 33.

A projecting mirror 20 is glued to a gasket 32. The gasket 32 can be received to an inner flange of the frame 30 so that the projecting mirror 20 is aligned to a center of the opening of the base 10.

The projecting lens is a convex lens and the projecting lens 20 will condense lights from the plurality of the LEDs 12.

Figure 3:
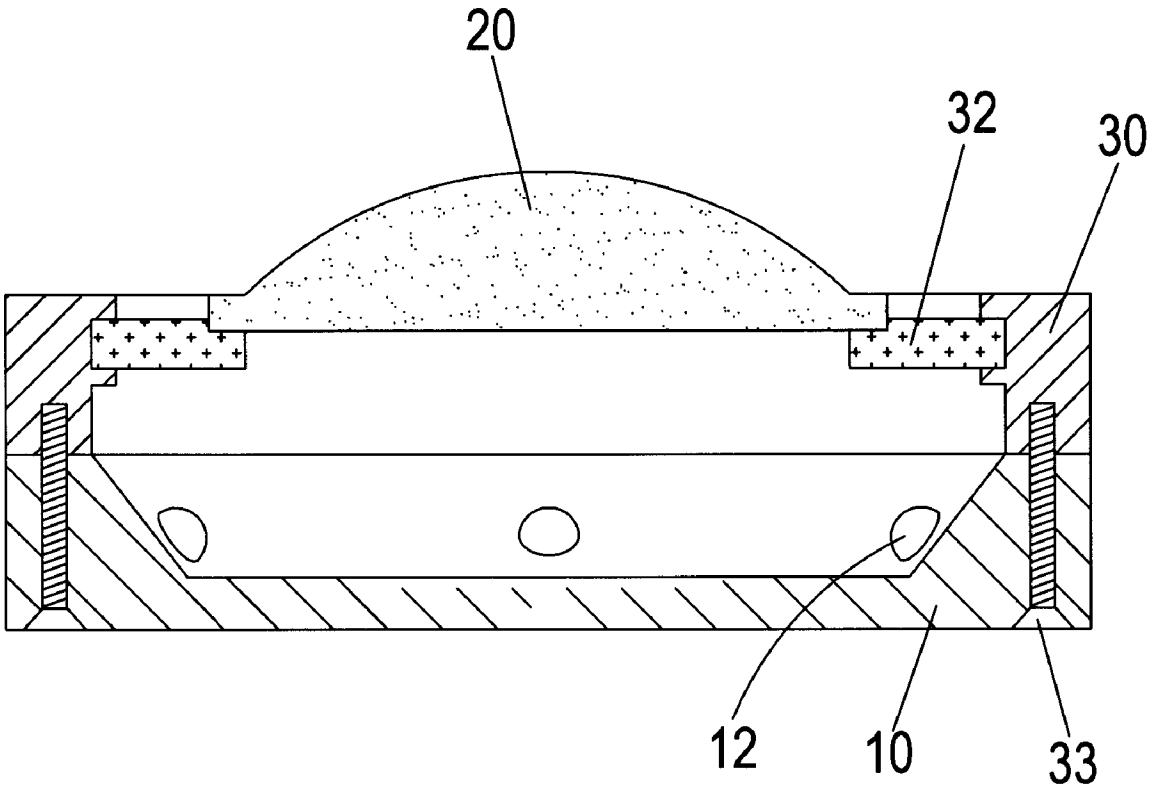
FIG. 3 is a cross section view of the present invention.
Figure 4:
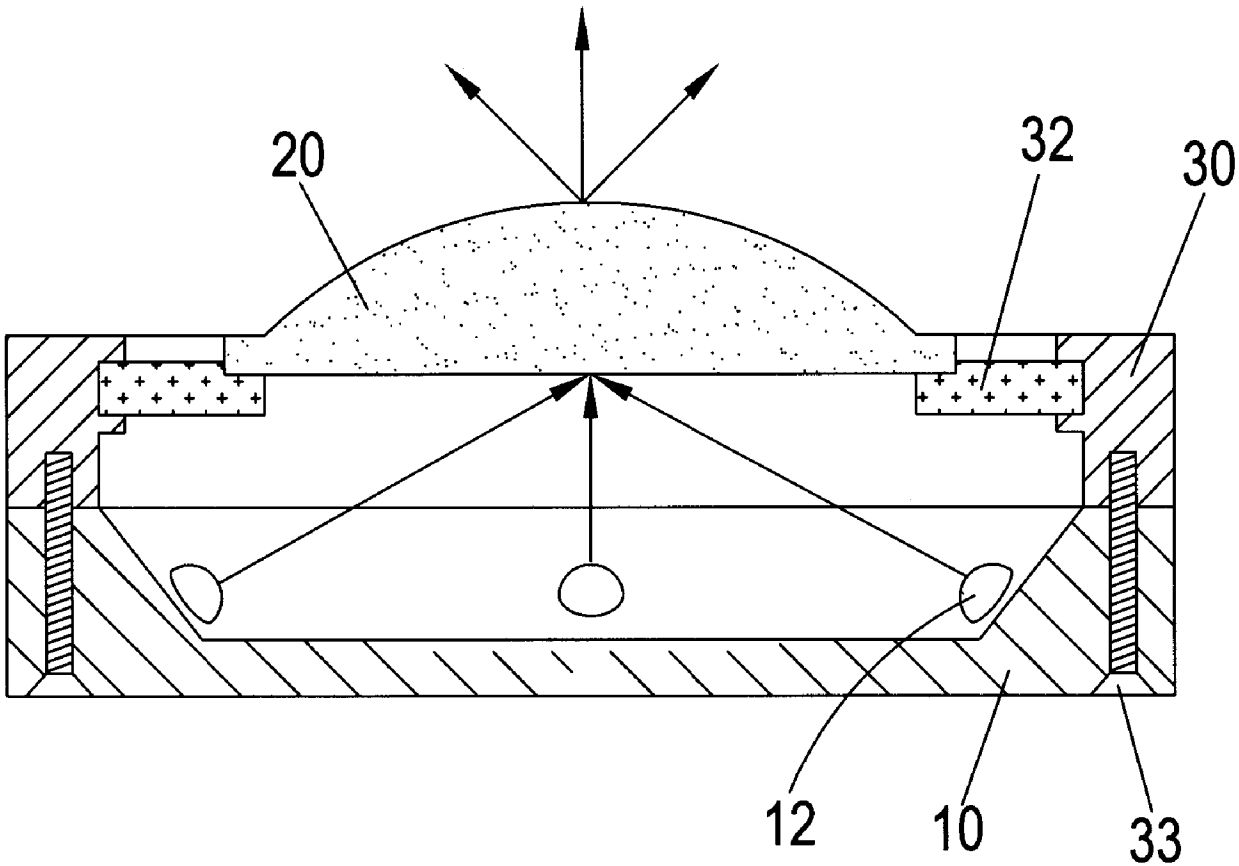
FIG. 4 is a cross section view showing an operation of the present invention.

Referring to FIG. 3, a cross section view of the embodiment of the present invention is shown. The plurality of the LEDs is arranged to point at a center of the projecting lens 20. A concentrated beam is condensed by lights of the LEDs on the base 10 through the projecting lens 20 as shown in FIG. 4.

Figure 5:
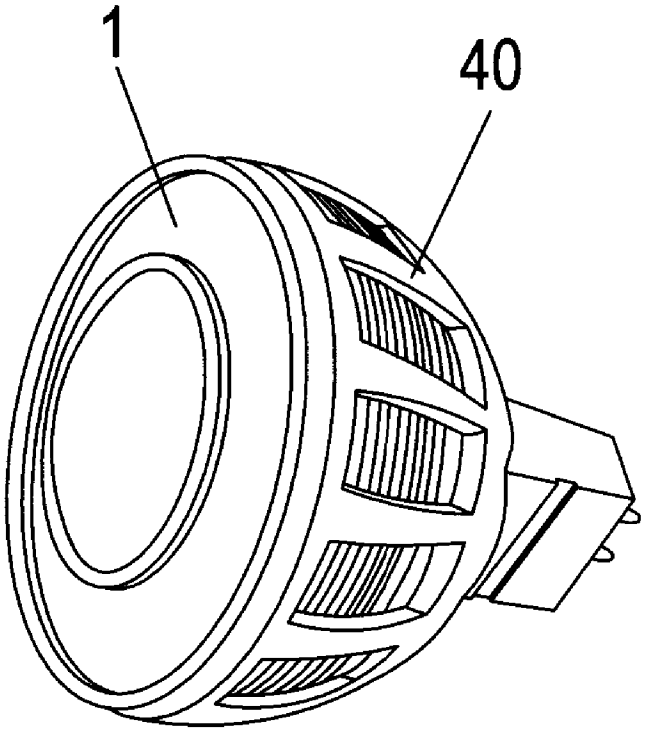
FIG. 5 is an embodiment of the present invention.

With reference to FIG. 5, the condensing device 1 is arranged to a projection lamp seat 40 so that the light of the projection lamp seat 40 can be projected to object on a stage for specific effect without scattering.

Furthermore, different color LEDs 12 can be arranged to the base 10 depending on the needs. For example, white light will be projected while red, blue, green LEDs 12 are arranged in the base 10 or blue and yellow LEDs with a same effect.

Figure 6:
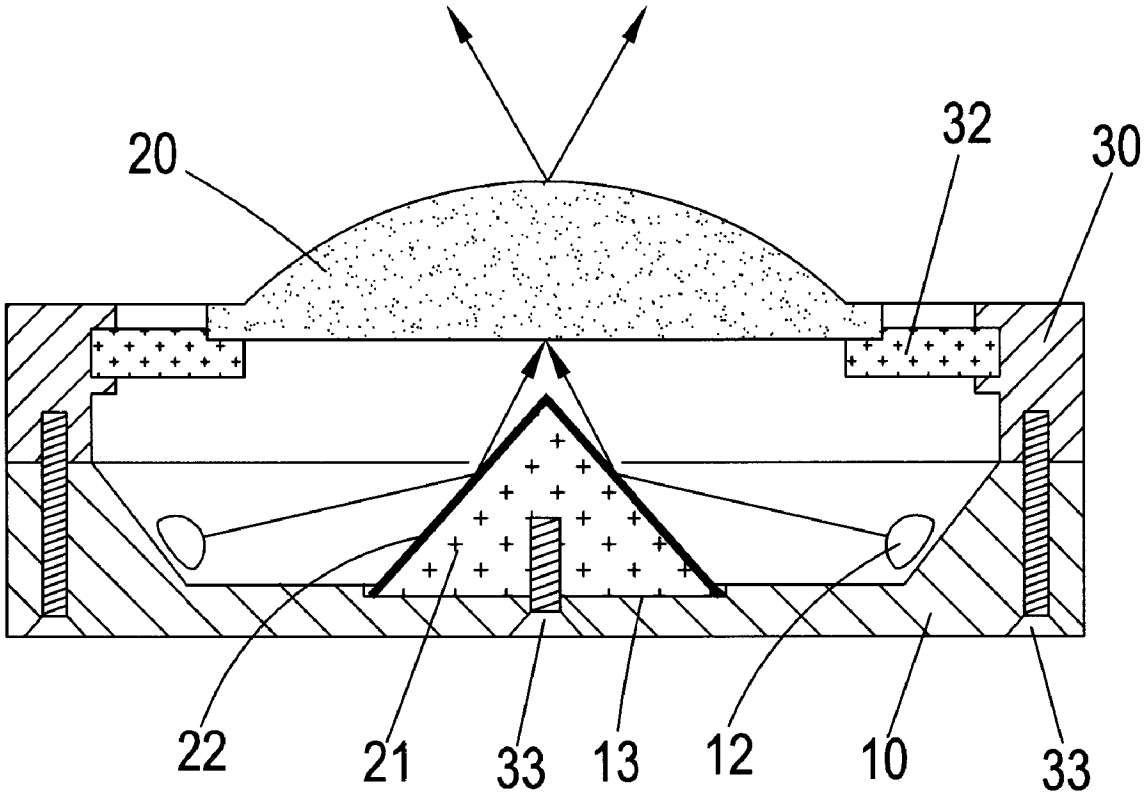
FIG. 6 is a cross section view showing an embodiment of the present invention having a reflecting pyramid.

Referring to FIG. 6, another embodiment of the present invention is illustrated. A reflecting pyramid 21 is arranged to a recess 13 on a center bottom of the base 10. The reflecting pyramid 21 is fixed by a bolt 33. Reflecting films 22 is formed to surfaces of the reflecting pyramid 21 so that lights from the LEDs will be reflected towards the projecting lens 20.

Figure 7:
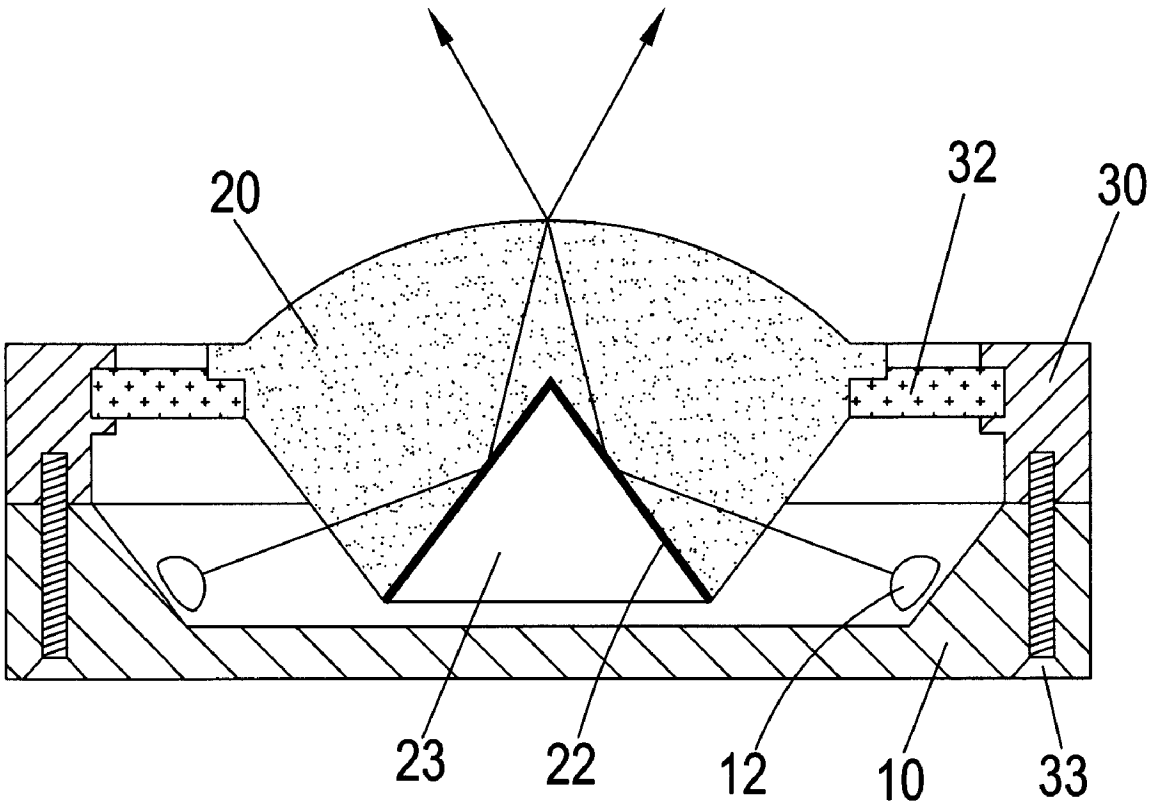
FIG. 7 is a cross section view showing one another embodiment of the present invention.

Referring to FIG. 7, a further embodiment of the present invention is illustrated. A projecting lens 20 has a cone cut 23 in a bottom thereof, and a reflecting film 22 is formed to a surface of the cone cut 23 so that lights from the LEDs 12 will be reflected towards the projecting lens 20.

The present invention has following advantages.

1. The simple structure and assembly is good for production.
2. The concentrated beam projected out from multiple LEDs will cause a single shadow to an object.
3. Different color of LEDs can be used in the present invention for different color purposes.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A condensing device for an LED comprising:

a base having a cone shaped opening with a wider opening on a top and a narrow opening on a bottom of the base; the LED being arranged to an inclined surface of the opening of the base; a frame having an inner flange being fixed to the top of the base;

a projecting lens fitted in a gasket, and the gasket being fixed to the inner flange of the frame so that the projecting lens being aligned to a center of the opening of the base; lights from the LED being concentrated projected outward without scattering; and wherein the base has a recess in a center bottom for receiving a reflecting pyramid; the reflecting pyramid is fixed by a bolt; reflecting films formed onto surfaces of the reflecting pyramid will reflect lights from the LED towards the projecting lens.

2. The condensing device for the LED as claimed in claim 1, wherein at least one LED is arranged to the base; lights from the at least one LED will be concentrated through the projecting lens.

3. The condensing device for LED as claimed in claim 1, wherein the base has a plurality of through holes, and the frame has a plurality of threaded holes on a bottom thereof; the plurality of the through holes is opposite to the plurality of threaded holes; the frame will be fixed to the base by tightening bolts through the through holes into the threaded holes.

4. The condensing device for the LED as claimed in claim 1, wherein the projecting lens is a convex lens.

5. The condensing device for LED as claimed in claim 1, wherein the projecting lens is glued to the gasket.

6. The condensing device for the LED as claimed in claim 1, wherein different color of LEDs are arranged to the base for different light purposes.

7. The condensing device for the LED as claimed in claim 1, wherein the projecting lens has a cone cut in a bottom thereof, and a reflecting film is formed to a surface of the cone cut so that lights from the LED will be reflected towards the projecting lens.

* * * * *